US009393792B2

(12) United States Patent
Satoh et al.

(10) Patent No.: US 9,393,792 B2
(45) Date of Patent: Jul. 19, 2016

(54) LIQUID DISCHARGE RECORDING APPARATUS AND METHOD FOR RECOVERING LIQUID

(71) Applicants: Noriaki Satoh, Nagoya (JP); Junichiro Sugimoto, Nagoya (JP); Ayako Ohishi, Nagoya (JP); Akihiko Taniguchi, Kakamigahara (JP)

(72) Inventors: Noriaki Satoh, Nagoya (JP); Junichiro Sugimoto, Nagoya (JP); Ayako Ohishi, Nagoya (JP); Akihiko Taniguchi, Kakamigahara (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 190 days.

(21) Appl. No.: 14/219,782

(22) Filed: Mar. 19, 2014

(65) Prior Publication Data

US 2014/0292912 A1 Oct. 2, 2014

(30) Foreign Application Priority Data

Mar. 29, 2013 (JP) ..... 2013-073972

(51) Int. Cl.
*B41J 2/17* (2006.01)

(52) U.S. Cl.
CPC ..... *B41J 2/1721* (2013.01); *B41J 2002/1728* (2013.01)

(58) Field of Classification Search
CPC ..... B41J 2/16523; B41J 2/16552; B41J 2/16558; B41J 2/1721; B41J 2/1728; B41J 2/1742; C11D 3/43; C11D 3/2068; C11D 3/2093; B41N 3/06
See application file for complete search history.

(56) References Cited

U.S. PATENT DOCUMENTS

| | | | | |
|---|---|---|---|---|
| 2004/0123774 | A1* | 7/2004 | Yamazaki | C09D 11/324 106/31.86 |
| 2006/0109322 | A1* | 5/2006 | Nakazawa | B41J 11/0065 347/95 |
| 2007/0137519 | A1* | 6/2007 | Sugimoto | B41J 2/16552 106/31.13 |
| 2011/0012956 | A1* | 1/2011 | Kagata | B41J 2/16532 347/29 |
| 2013/0300799 | A1* | 11/2013 | Mizutani | B41J 2/16505 347/30 |

FOREIGN PATENT DOCUMENTS

| | | | |
|---|---|---|---|
| JP | 2003-128969 | A | 5/2003 |
| JP | 2003-147243 | A | 5/2003 |
| JP | 2004-284171 | A | 10/2004 |

* cited by examiner

*Primary Examiner* — An Do
*Assistant Examiner* — Renee I Wilson
(74) *Attorney, Agent, or Firm* — Banner & Witcoff, Ltd.

(57) ABSTRACT

A liquid discharge recording apparatus includes: a liquid containing first glycol ether; a liquid discharge head which discharges the liquid; an absorber which absorbs the liquid discharged from the liquid discharge head; and second glycol ether which is contained in the absorber and of which vapor pressure is lower than that of the first glycol ether.

10 Claims, 2 Drawing Sheets

LIQUID DISCHARGE RECORDING APPARATUS AND METHOD FOR RECOVERING LIQUID

CROSS REFERENCE TO RELATED APPLICATION

The present application claims priority from Japanese Patent Application No. 2013-073972 filed on Mar. 29, 2013, the disclosure of which is incorporated herein by reference in its entirety.

BACKGROUND OF THE INVENTION

1. Field of the Invention

The present invention relates to a liquid discharge recording apparatus and a method for recovering liquid.

2. Description of the Related Art

Conventionally, a water-based ink for ink-jet recording (hereinafter referred to as a "water-based ink" or an "ink" in some cases) has been using, as a solvent, a volatile organic solvent (see, for example, Japanese Patent Application Laid-open No. 2003-147243). In the recent years, however, there is a demand for the water-based ink to reduce the generation of any VOC (Volatile Organic Compounds), in view of protection of the global environment. For this purpose, there are proposed measurement such as reducing the blending amount (content) of the volatile organic solvent in the water-based ink, as using a water-soluble organic solvent which is non-volatile with respect to the water-based ink, etc., so as to reduce the generation of the VOC (see, for example, Japanese Patent Application Laid-open No. 2003-128969).

In the recent years, there is an increased demand for further reducing the generation of VOC as the consumption of ink is increased due to the improvement in recording speed. On the other hand, in a case that a non-volatile organic solvent is added to a water-based ink as the countermeasure against the VOC, the quick-drying property during recording and the spreading into a recording medium such as a recording paper (recording sheet), etc., are not sufficient, making it difficult to satisfy the property or performance as a water-based ink adapted for a high-speed recording. In view of the situation described above, there is a demand for a liquid discharge recording apparatus, such as an ink-jet recording apparatus, which is adapted to the high-speed recording as well as capable of further reducing the generation of VOC more than the conventional technique.

An object of the present teaching is to provide a liquid discharge recording apparatus and a method for recovering a liquid which are capable of reducing the generation of VOC.

SUMMARY OF THE INVENTION

According to a first aspect of the present teaching, there is provided a liquid discharge recording apparatus including:

a liquid containing first glycol ether;

a liquid discharge head configured to discharge the liquid;

an absorber configured to absorb the liquid discharged from the liquid discharge head; and second glycol ether which is contained in the absorber and of which vapor pressure is lower than that of the first glycol ether.

According to a second aspect of the present teaching, there is provided a liquid-recovery method for recovering a liquid in a liquid discharge recording apparatus, the method including;

discharging the liquid containing first glycol ether from a liquid discharge head of the liquid discharge recording apparatus; and absorbing the discharged liquid with an absorber which is provided in the liquid discharge recording apparatus and contains second glycol ether having lower vapor pressure than that of the first glycol ether.

DESCRIPTION OF THE PREFERRED EMBODIMENTS

Figure 1:
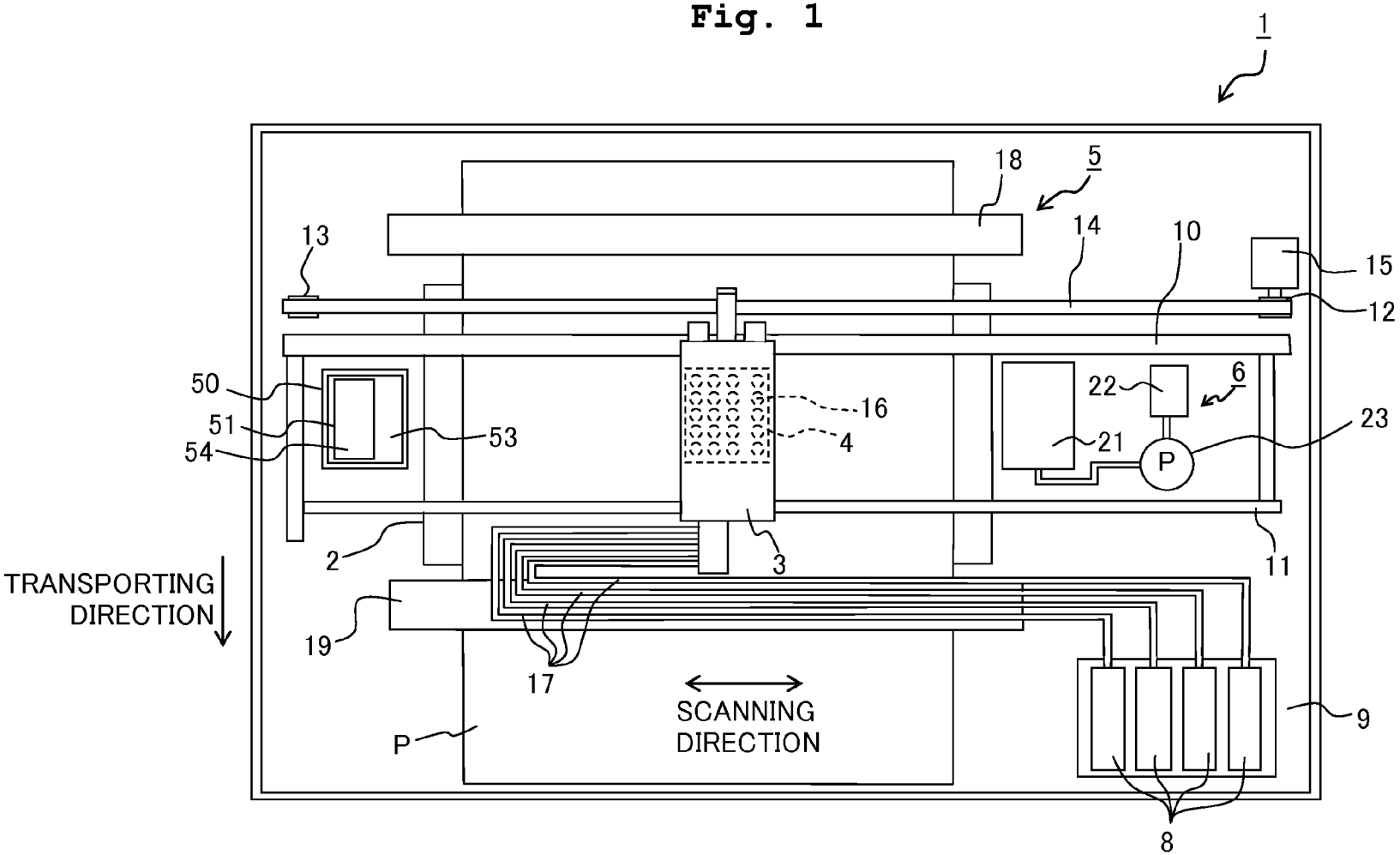
FIG. 1 is a schematic plane view showing the configuration of an example of a liquid discharge recording apparatus of the present teaching.

The liquid usable in the liquid discharge recording apparatus of the present teaching includes, for example, a water-based ink for ink-jet recording, a treatment liquid (treatment solution) which is used in the ink-jet recording, etc. The treatment liquid is a liquid which is discharged toward a recording medium before or after the discharge of ink, for the purpose of improving the image quality, etc. Further, the liquid is not limited to a liquid to be used for ink-jet recording, and is exemplified by, for example, a preservative liquid (shipping liquid), an introductory liquid, an inspection liquid, etc. The preservative liquid is a liquid charged into a flow channel, of a liquid discharge recording apparatus, in a state of shipped out from the factory so as to preserve that state inside the flow channel. The preservative liquid also functions as follows: after the liquid discharge recording apparatus has been shipped from the factory and when an user introduces an ink to the flow channel of the liquid discharge recording apparatus, the preservative liquid functions to promote the introduction of the ink into the flow channel. The introductory liquid is a liquid which is charged in advance into the flow channel of the liquid discharge recording apparatus after a liquid discharge head of the apparatus has been produced and when the ink is introduced into the flow channel in the factory, such that the ink is easily introduced into the flow channel. The inspection liquid is a liquid to be used for inspecting the discharge of the liquid discharge head in the factory. As described above, the liquid contains glycol ether (first glycol ether). It is allowable to prepare the liquid on the premise or location where the liquid discharge recording apparatus is installed, or to use any commercially available liquid product which contains glycol ether. According to the present teaching, it is possible to reduce the volatilization of the glycol ether contained in the liquid. Therefore, for example, it is possible to add a necessary and sufficient amount of the glycol ether to an ink applied to the liquid discharge recording apparatus of the present teaching, thereby making it possible to improve the quick-drying property and the image quality as well.

There is known the "coexistence effect" wherein a substance having a low vapor pressure is allowed to coexist with a substance having a high vapor pressure, thereby making it possible to volatilize the substance having the low vapor pressure. The present teaching views this "coexistence effect" from the opposite standpoint, and is based on a concept that the volatilization of the glycol ether (first glycol ether) contained in the liquid is reduced by allowing the absorber to contain another glycol ether (second glycol ether) of which vapor pressure is lower than that of the glycol ether (first glycol ether) contained in the liquid. The inventors of the present teaching were the first to obtain this concept. Base on the concept, the inventors of the present teaching found out that the volatilization of the glycol ether contained in the liquid can be reduced by absorbing the liquid with the absorber containing another glycol ether of which vapor pressure is lower than that of the glycol ether contained in the liquid. Thus, according to the present teaching, it is possible to provide a liquid discharge recording apparatus and a liquid recovery method which are capable of reducing the generation of VOC. The method for causing the absorber to absorb the liquid is not particularly limited; it is allowable, for example, to cause the absorber to absorb the liquid by discharging the liquid toward the absorber by a liquid discharge head such as an ink-jet head or to allow the absorber to absorb the liquid sucked from the liquid discharge head by a suction pump, as will be described below.

In the liquid discharge recording head of the present teaching, the glycol ether (first glycol ether) contained in the liquid is preferably a volatile glycol ether, and another glycol ether (second glycol ether) contained in the absorber is preferably a non-volatile glycol ether. Each of the first and second glycol ethers is not a solid insoluble to water, but has the solubility to water.

Note that it is possible to confirm whether glycol ether is volatile or non-volatile by, for example, the following method. Namely, at first, 5 g of glycol ether is poured into an open container (open vial, opening size (diameter): 20.2 mm). Then, the open vial is stored for one week at a temperature of 60 degrees Celsius and a relative humidity of 40%. After the storage, in a case that the evaporation rate of the glycol ether exceeded 5%, such glycol ether is judged to be volatile, and in a case that the evaporation rate of the glycol ether is not more than 5%, such glycol ether is judged to be non-volatile. Table 1 shows the results of confirmation for representative glycol ethers confirmed by this method.

TABLE 1

| GLYCOL ETHERS | Propylene glycol methyl ether (PM) | Propylene glycol ethyl ether (PE) | Propylene glycol butyl ether (PB) | Dipropylene glycol propyl ether (DPP) | Dipropylene glycol butyl ether (DPB) | Tripropylene glycol methyl ether (TPM) | Triethylene glycol butyl ether (TEB) | Tetraethylene glycol butyl ether (TeEB) | Tripropylene glycol butyl ether (TPB) |
|---|---|---|---|---|---|---|---|---|---|
| Vapor pressure (20° C.) | 8.9 hPa | 10 hPa | 0.8 hPa | 0.1 hPa | 0.07 hPa | 0.03 hPa | <0.01 hPa | <0.01 hPa | <0.01 hPa |
| Molecular weight | 90.1 | 104.2 | 132.2 | 176.3 | 190.3 | 206.3 | 206.3 | 250.0 | 248.8 |
| Boiling point (° C.) | 121.0 | 133.0 | 170.2 | 212.0 | 230.6 | 242.4 | 271.2 | 304.0 | 274.0 |
| Evaporation rate (%) | 100 | 100 | 100 | 88.0 | 36.6 | 22.8 | 0 | 0 | 2.2 |
| Results of confirmation | volatile | volatile | volatile | volatile | volatile | volatile | non-volatile | non-volatile | non-volatile |

The volatile glycol ether includes, for example, ethylene glycol methyl ether (EM), diethylene glycol methyl ether (DEM), ethylene glycol ethyl ether (EE), diethylene glycol ethyl ether (DEE), ethylene glycol propyl ether (EP), ethylene glycol butyl ether (EB), ethylene glycol hexyl ether (EHe), propylene glycol methyl ether (PM) dipropylene glycol methyl ether (DPM), tripropylene glycol methyl ether (TPM), propylene glycol ethyl ether (PE), propylene glycol propyl ether (PP), dipropylene glycol propyl ether (DPP), propylene glycol butyl ether (PB), dipropylene glycol butyl ether (DPB), etc. The volatile glycol ether is preferably DPM, PE, DPP and PB, and is more preferably DPP. It is allowable that only one kind of the above volatile glycol ethers is contained in the liquid, or that two or more kinds of the above volatile glycol ethers are contained in the liquid.

The non-volatile glycol ether includes, for example, triethylene glycol methyl ether (TEM), triethylene glycol ethyl ether (TEE), diethylene glycol butyl ether (DEB), triethylene glycol butyl ether (TEB), tetraethylene glycol butyl ether (TeEB), pentaethylene glycol butyl ether (PEB), diethylene glycol hexyl ether (DEHe), tripropylene glycol butyl ether (TPB), etc. The non-volatile glycol ether is preferably TEB, TeEB and TPB. It is allowable that only one kind of the above non-volatile glycol ethers is contained in the absorber, or that two or more kinds of the above non-volatile glycol ethers are contained in the absorber.

Table 2 shows the vapor pressure of the representative glycol ethers.

TABLE 2

| | Abbreviated Name | Name | Vapor Pressure |
|---|---|---|---|
| Volatile Glycol Ethers | EM | Ethylene glycol methyl ether | 8.3 hPa (20° C.) |
| | DEM | Diethylene glycol methyl ether | 0.1 hPa (20° C.) |
| | EE | Ethylene glycol ethyl ether | 0.5 kPa (20° C.) |
| | DEE | Diethylene glycol ethyl ether | 0.13 hPa (20° C.) |
| | EP | Ethylene glycol propyl ether | 130 Pa (25° C.) |
| | EB | Ethylene glycol butyl ether | 0.8 hPa (20° C.) |
| | EHe | Ethylene glycol hexyl ether | 0.1 hPa (20° C.) |
| | PM | Propylene glycol methyl ether | 8.9 hPa (20° C.) |
| | DPM | Dipropylene glycol methyl ether | 0.08 hPa (20° C.) |
| | TPM | Tripropylene glycol methyl ether | 0.03 hPa (20° C.) |
| | PE | Propylene glycol ethyl ether | 1 kPa (25° C.) |
| | PP | Propylene glycol propyl ether | 2.3 hPa (20° C.) |
| | DPP | Dipropylene glycol propyl ether | 0.1 hPa (20° C.) |
| | PB | Propylene glycol butyl ether | 0.8 hPa (20° C.) |
| | DPB | Dipropylene glycol butyl ether | 0.07 hPa (20° C.) |

TABLE 2-continued

| | Abbreviated Name | Name | Vapor Pressure |
|---|---|---|---|
| Non-Volatile Glycol Ethers | TEM | Triethylene glycol methyl ether | <0.01 hPa (20° C.) |
| | TEE | Triethylene glycol ethyl ether | <0.01 hPa (20° C.) |
| | DEB | Diethylene glycol butyl ether | 0.01 hPa (20° C.) |
| | TEB | Triethylene glycol butyl ether | <0.01 hPa (20° C.) |
| | TeEB | Tetraethylene glycol butyl ether | <0.01 Pa (20° C.) |
| | DEHe | Diethylene glycol hexyl ether | <0.01 Pa (20° C.) |
| | TPB | Tripropylene glycol butyl ether | <0.01 hPa (20° C.) |

In the liquid discharge recording apparatus of the present teaching, each of the glycol ether contained in the liquid (first glycol ether) and the glycol ether contained in the absorber (second glycol ether) may be alkylene glycol monoalkyl ether represented by the following general formula (1):

$$R^1O—(R^2O)_n—H\ldots \quad (1)$$

wherein in the general formula (1), "$R^1$" is preferably unsubstituted straight-chain or branched-chain alkyl group having 1 to 6 carbons, and is more preferably unsubstituted straight-chain or branched-chain alkyl group having 1 to 4 carbons. "$R^2$" is preferably unsubstituted straight-chain or branched-chain alkylene group having 2 or 3 carbons; "n" is preferably an integer of 1 to 4, and is more preferably an integer of 2 to 4. As the glycol ether represented by the general formula (1) wherein $R^1$ is the unsubstituted straight-chain or branched-chain alkyl group having 1 to 4 carbons, $R^2$ is the unsubstituted straight-chain or branched-chain alkylene group having 2 or 3 carbons, and n is the integer of 2 to 4 is exemplified by, for example, volatile glycol ethers such as DPM, DPP, etc. and non-volatile glycol ethers such as TEB, TeEB, TPB, etc. The above-described effect viewing the "coexistence effect" from the opposite standpoint easily manifests (is easily achieved) between substances having similar chemical structures. Therefore, by allowing both of the first and second glycol ethers to have alkylene oxide chains which are similar to each other, it is possible to reduce the volatilization of the glycol ether contained in the liquid (first glycol ether) more effectively.

In the liquid discharge recording apparatus of the present teaching, the combination of the glycol ether contained in the liquid (first glycol ether) and the glycol ether contained in the absorber (second glycol ether) is preferably either one of a combination wherein the first glycol ether is DPP and the second glycol ether is TEB, a combination wherein the first glycol ether is DPP and the second glycol ether is TeEB, or a combination wherein the first glycol ether is DPP and the second glycol ether is TPB. In these combinations, it is possible to reduce the volatilization of the glycol ether contained in the liquid (first glycol ether) more effectively in the mechanism viewing the "coexistence effect" from the opposite standpoint.

In a case that the liquid is a water-based ink, the water-based ink contains a colorant, water and glycol ether (first glycol ether). The colorant may be at least one of a dye and a pigment. The blending amount of the colorant with respect to the entire amount of the water-based ink is not particularly limited, and may be appropriately determined based on, for example, desired optical density or color (hue, tint), etc. The blending amount of the colorant is, for example, 0.2% by weight to 20% by weight, and is preferably 2% by weight to 10% by weight.

It is preferable that the water contained in the water-based ink is ion exchange water or pure water (purified water). The blending amount of water (water ratio) with respect to the entire amount of the water-based ink is, for example, 10% by weight to 90% by weight, and preferably 40% by weight to 80% by weight. The water ratio may be, for example, the balance of the other components.

The glycol ether contained in the water-based ink (first glycol ether) is not specifically limited, but is preferably volatile glycol ether as described above, is more preferably at least one selected from the group consisting of DPM, PE, DPP and PB, and is further more preferably DPP. The water-based ink may contain two or more kinds of the glycol ethers, but may contain substantially only one kind of the glycol ethers. It is allowable that the water-based ink contains, as the glycol ether, only one selected from the group consisting of DPM, PE, DPP and PB, but does not contain any other glycol ether; or it is allowable that the water-based ink contains, as the glycol ether, only DPP, but does not contain any other glycol ether. Although the blending amount of the glycol ether with respect to the entire amount of the water-based ink is not specifically limited, but is for example 0.1% by weight to 20% by weight, is preferably 0.2% by weight to 10% by weight, and is more preferably 0.3% by weight to 6% by weight.

The water-based ink may further contain any other additive(s) such as penetrants, humectants, surfactants, rust-preventing agents, fungicides, etc. In particular, it is preferable that the water-based ink contains 5% by weight to 40% by weight of glycerol as the humectant, more preferably in an amount of 10% by weight to 30% by weight of glycerol.

The water-based ink can be prepared, for example, such that the pigment, water, the glycol ether and optionally other additive component(s) are mixed uniformly or homogeneously by any conventionally known method, and undissolved matters are removed by a filter or the like.

In a case that the liquid is a preservative liquid (shipping liquid), the preservative liquid may have a composition similar to that of the water-based ink, except for the blending amount of the colorant, and the preservative liquid may be prepared in a method similar to the method for preparing the water-based ink. The preservative liquid is a liquid to be charged in a flow channel of the liquid discharge recording apparatus so as to maintain the state of the flow channel. Therefore, it is allowable that the preservative liquid does not contain any colorant, or that the preservative liquid contains a colorant so that the presence of the preservative liquid can be visually confirmed. In a case that the preservative liquid contains a colorant, the blending amount of the colorant in the preservative liquid is preferably not more than 0.5% by weight.

In the liquid discharge recording apparatus of the present teaching, the absorber which absorbs the liquid discharged from the liquid discharge head may be any absorber provided that the absorber is capable of absorbing the liquid. For example, the absorber is exemplified by melamine foam, urethane foam, polyethylene foam, silicone foam, acrylic foam, chloroprene rubber (CR) sponge, natural rubber (NR) sponge, nitrile rubber (NBR) sponge, ethylene propylene diene rubber (EPDM) sponge, felt foam, needle felt among which melamine foam is preferable.

Although the glycol ether contained in the absorber (second glycol ether) may be any glycol ether provided that the glycol ether has a vapor pressure lower than that of the glycol ether contained in the liquid (first glycol ether), the second glycol ether is preferably non-volatile glycol ether as described above, and is preferably at least one selected from the group consisting of TEB, TeEB and TPB. Further, it is allowable that the second glycol ether of which vapor pressure is lower than that of the first glycol ether is substantially composed only of the non-volatile glycol and that the second glycol does not contain any volatile glycol ether. Even in a case that the absorber contains any volatile glycol ether, it is preferable that the ratio of the non-volatile glycol ether to the entire amount of the glycol ethers contained in the absorber is not less than 95% by weight.

In view of preventing the liquid from dripping or leaking from the absorber, the amount of the glycol ether (second glycol ether) contained per 1 $mm^3$ of the absorber is preferably not more than 0.91 $\mu g/mm^3$, and is more preferably not more than 0.7 $\mu g/mm^3$. Further, in view of sufficiently suppressing the volatilization of the glycol ether (first glycol ether) contained in the liquid, the amount of the glycol ether (second glycol ether) contained per 1 $mm^3$ of the absorber is preferably not less than 0.1 $\mu g/mm^3$, and is more preferably not less than 0.2 $\mu g/mm^3$. Furthermore, the amount of the glycol ether (second glycol ether) contained in the absorber may be determined depending on, for example, the amount of glycol ether (first glycol ether) contained in the liquid, the period of service life or lifetime of the liquid discharge recording apparatus, etc. For example, in a case that the absorber is a flushing absorber (to be described later on) of the liquid discharge recording apparatus, the amount of the glycol ether (second glycol ether) contained in the flushing absorber is preferably not less than 0.10 g, is more preferably not less than 0.18 g, is preferably not more than 0.81, and is more preferably not more than 0.63 g.

Next, a liquid discharge recording apparatus and a liquid recovery method of the present teaching will be specifically explained. The liquid discharge recording apparatus of the present teaching includes a liquid discharge head which discharges a liquid and an absorber which absorbs the liquid discharged from the liquid discharge head. The absorber is preferably at least one of a flushing absorber and a waste liquid absorber. In the liquid discharge recording apparatus of the present teaching, the configuration of the liquid discharge recording apparatus, except for the absorber, may be similar to that of a conventional liquid discharge recording apparatus such as an ink-jet recording apparatus. The liquid recovery method of the present teaching is practiced by using the liquid discharge recording apparatus of the present teaching.

FIG. 1 shows the configuration of an example of the liquid discharge recording apparatus of the present teaching. As shown in FIG. 1, a liquid discharge recording apparatus 1 of the present teaching includes a platen 2, a carriage 3, an ink-jet head (liquid discharge head) 4, a transporting mechanism 5 and a maintenance unit 6 as main constitutive components or parts.

A recording medium (for example, recording paper or recording sheet) P supplied from a paper feeding mechanism (not shown in the drawings) is placed on the upper surface of the platen 2. Two guide rails 10 and 11 are arranged at a position above or over the platen 2, and extend parallel to each other in the scanning direction (left/right direction in FIG. 1). The carriage 3 is movable in a reciprocating manner in the scanning direction along the two guide rails 10 and 11 in an area at which the carriage 3 faces or is opposite to the platen 2.

The two guide rails 10 and 11 extend in the scanning direction to further protrude from the left and right ends of the platen 2. The carriage 3 is configured to be movable from the area facing the recording paper P on the platen 2 (recording area) to a position located away from both of the left/right ends of the platen 2 (non-recording area). An endless belt 14 wound between two pulleys 12 and 13 is connected to the carriage 3. By driving the endless belt 14 to run by a carriage driving motor 15, the carriage 3 is reciprocated in the scanning direction, accompanying with the running of the endless belt 14.

The ink-jet head 4 is installed in a lower portion of the carriage 3. The lower surface of the ink-jet head 4 is a liquid discharge surface 4*a* (see FIG. 2) which is parallel to the upper surface of the platen 2 and in which a plurality of nozzles 16 are opened. The liquid is discharged from the plurality of nozzles 16 of the liquid discharge surface 4*a* toward the recording paper P placed on the platen 2 so as to perform recording on the recording paper P.

Four ink supply ports (not shown in the drawings) corresponding to colors of black, yellow, cyan and magenta, respectively are provided on the upper surface of the ink-jet head 4, and one ends of four tubes 17 are connected to the four ink supply ports, respectively. The other ends of the four tubes 17 are connected to a cartridge installation section 9 that is configured such that four ink cartridges 8 storing the four color inks respectively are detachably attached to the cartridge installation section 9. With this configuration, the inks of the respective four colors are supplied to the ink-jet head 4 from the four ink cartridges 8 installed in the cartridge installation section 9 via the four tubes 17, respectively.

The transporting mechanism 5 has two transporting rollers 18 and 19 which are arranged so as to sandwich the platen 2 therebetween in a transporting direction (direction from the upper portion to the lower portion on the sheet surface in FIG. 1). The recording paper P placed on the platen 2 is transported in the transporting direction by the two transporting rollers 18 and 19.

The liquid discharge recording apparatus 1 discharges the liquid from the ink-jet head 4 installed in the carriage 3 toward the recording paper P placed on the platen 2 and transports the recording paper P in the transporting direction by the two transporting rollers 18 and 19, thereby printing desired image and/or letter, etc., on the recording paper P.

Next, the maintenance unit 6 will be explained. The maintenance unit 6 includes a purge unit and a flushing unit. The purge unit has a waste liquid absorber 22, a suction cap 21 and a suction pump 23 which are arranged on one side in the scanning direction (on the right side in FIG. 1) with respect to the platen 2. The flushing unit is arranged on the other side in the scanning direction (on the left side in FIG. 1) with respect to the platen 2, and includes a first flushing absorber 53, a second flushing absorber 54, a waste liquid tank 50 and a liquid receiving member 51, as main constitutive components or parts.

The suction cap 21 is driven by a cap driving mechanism including a driving mechanism such as a motor (not shown) so that the suction cap 21 is moved in the up and down direction and to make approach/separation with respect to the liquid discharge surface 4*a*. The suction pump 23 is connected to the suction cap 21. When the suction cap 21 makes contact with the liquid discharge surface 4*a*, the suction cap 21 covers the openings of the plurality of nozzles 16. In a case that the suction cap 21 is in a capping state in such a manner, the suction pump 23 is driven to perform suction and depressurization in the inside of the suction cap 21, thereby causing the liquid to be discharged from all of the nozzles 16 covered by the suction cap 21 (suction purge). The suction pump 23 is connected to the waste liquid absorber 22. The liquid sucked and discharged from the nozzles 16 by the suction purge is absorbed by the waste liquid absorber 22 via the suction pump 23. Although not shown in the drawings, the waste liquid absorber 22 is accommodated in a box which is open at an upper portion of the box. The waste liquid absorber 22 may be any member provided that such a member is capable of absorbing a liquid, such as, for example, a melamine foam, etc. In the embodiment, the purge unit is configured to suck the liquid from the nozzles 16 by the suction pump 23. However, the purge unit may be configured as a so-called "push purge" mechanism which applies pressure to the liquid inside the ink-jet head 4 to thereby cause the liquid to be discharged from the nozzles 16. Namely, the liquid absorbed by the absorber in the present teaching may be a liquid which is discharged actively from the nozzles, or a liquid which is discharged forcibly from the nozzles as in the suction purge. Alternatively, in the present teaching, it is allowable to provide such an aspect wherein the absorber receives the liquid discharged directly to the absorber, or another aspect wherein the absorber receives the liquid indirectly, e.g. a liquid fed from the suction pump, etc. to the absorber.

Figure 2:
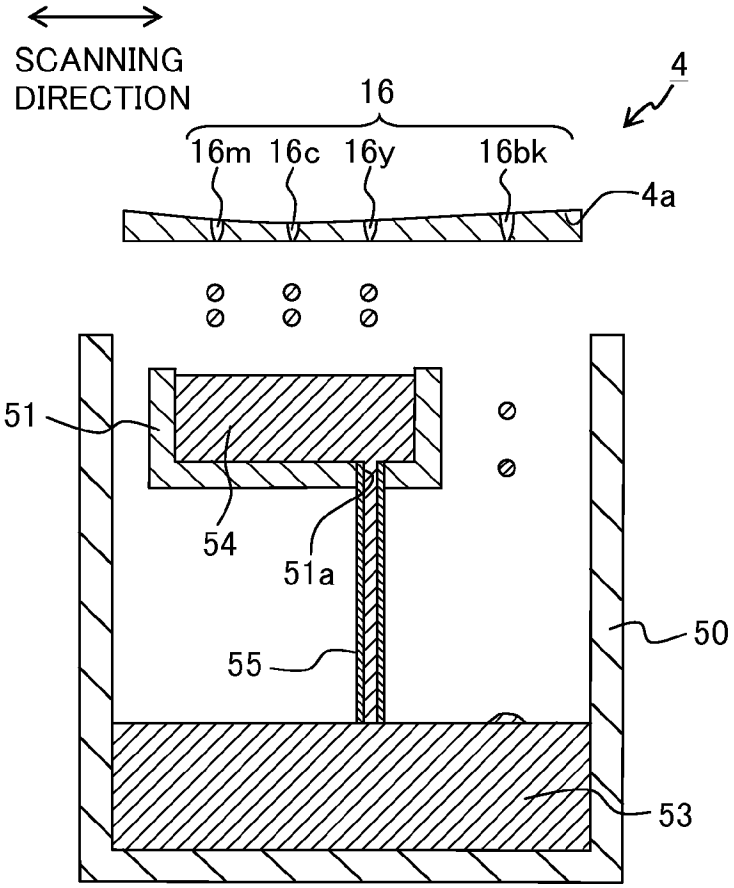
FIG. 2 is a cross-sectional view of a waste liquid tank in a vertical plane including the scanning direction when the liquid discharge recording apparatus shown in FIG. 1 performs liquid recovery operation.

As shown in FIG. 2, the waste liquid tank 50 has a box-shape which is open at an upper portion thereof, and accommodates the first flushing absorber 53 inside of the waste liquid tank 50. The liquid receiving member 51 is arranged at a position above or over the first flushing absorber 53. The liquid receiving member 51 has a box-shape which is open at an upper portion thereof, and accommodates the second flushing absorber 54 inside of the liquid receiving member 51. A discharge port 51*a* is formed in the liquid receiving member 51 at a portion on the bottom surface and located on one side in the scanning direction (on the right side in FIG. 2). The discharge port 51*a* is connected to one end of a tube 55 of which other end makes contact with the upper surface of the first flushing absorber 53. With this, the liquid absorbed by the upper surface of the second flushing absorber 54 moves downwardly and is discharged from the discharge port 51*a* to the first flushing absorber 53, via the tube 55. Each of the first and second flushing absorbers 53 and 54 may be any member provided that such a member is capable of absorbing a liquid, such as, for example, a melamine foam, etc.

The first flushing absorber 53, the second flushing absorber 54 and the waste liquid absorber 22 contain glycol ether of which vapor pressure is lower than that of the glycol ether contained in the liquid. In each of the first and second flushing absorbers 53 and 54, the glycol ether having the lower vapor pressure may be contained only at a portion which makes contact with the liquid discharged from the ink-jet head 4, or may be contained in the entirety of each of the first and second flushing absorbers 53 and 54.

Next, an example of the liquid recovery method of the present teaching will be explained with reference to FIG. 2. This example is an aspect wherein the liquid is recovered by discharging the liquid from the ink-jet head 4 directly to the flushing absorber. FIG. 2 is a cross-sectional view of the waste liquid tank 50 in a vertical plane including the scanning direction when the liquid discharge recording apparatus 1 shown in FIG. 1 performs liquid recovery operation. In FIG. 2, reference numerals "16*bk*", "16*y*", "16*c*" and "16*m*" indicate nozzles 16 for the black, yellow, cyan and magenta inks, respectively. In the liquid discharge recording apparatus 1, the ink-jet head 4 may further have a nozzle and a supply port for a treatment liquid. The liquid discharge recording apparatus 1 may further have a cartridge in which the treatment liquid is stored and a tube for supplying the treatment liquid.

When the liquid is recovered in this example, the ink-jet head 4 is stopped, without scanning in the scanning direction, and the inks discharged from the nozzles 16 are discharged immediately downwardly. FIG. 2 shows an example wherein liquid recovery for recovering the black ink from the nozzle 16*bk* and liquid recovery for recovering the three color inks that are yellow, cyan and magenta inks from the nozzles 16*y*, 16*c* and 16*m* are performed at the same time.

In FIG. 2, the liquids are recovered by discharging the inks of the respective colors that are the black ink and the yellow, cyan and magenta inks from the nozzle 16*bk* of the black ink and the nozzles 16*y*, 16*c* and 16*m* of the three color inks toward the first flushing absorber 53 accommodated in the waste liquid tank 50 and the second flushing absorber 54 accommodated in the liquid receiving member 51, respectively, at a position at which the nozzle 16*bk* of the black ink is made to face or to be opposite to the first flushing absorber 53, and at which the nozzles 16*y*, 16*c* and 16*m* of the three color inks are made to face the second flushing absorber 54. Note that the liquid recovery of the liquid from the nozzle 16*bk* of the black ink and the liquid recovery of the liquids from the nozzles 16*y*, 16*m*, and 16*c* of the three color inks may be performed separately from each other. Further, in a case that the ink-jet head 4 has the nozzle for the treatment liquid, liquid recovery of the liquid from the nozzle for the treatment liquid can also be performed by moving the nozzle for the treatment liquid to a position facing or to be opposite to the first or second flushing absorber 53 or 54, in a similar manner as for the recovery of the inks.

The glycol ether, of which vapor pressure is lower than that of the glycol ether contained in the liquid, is contained in the first and second flushing absorbers 53 and 54. Therefore, it is possible to reduce the volatilization of the glycol ether contained in the liquid by the above-described mechanism viewing the "coexistence effect" from the opposite standpoint.

Next, another example of the liquid recovery method of the present teaching will be explained with reference to FIG. 1. As described above, in the liquid discharge recording apparatus 1 shown in FIG. 1, the liquid sucked and discharged by the suction purge is absorbed by the waste liquid absorber 22 via the suction pump 23. Since the waste liquid absorber 22 also contains the glycol ether of which vapor pressure is lower than that of the glycol ether contained in the liquid, it is possible to reduce the volatilization of the glycol ether contained in the liquid by the above-described mechanism viewing the "coexistence effect" from the opposite standpoint. In such a manner, the present teaching is applicable also to an aspect wherein the liquid discharged from the ink-jet head 4 is absorbed by the waste liquid absorber 22 via the suction pump 23, without being limited only to the case that the liquid discharged from the ink-jet head 4 is directly absorbed.

In this embodiment, each of the first flushing absorber 53, the second flushing absorber 54 and the waste liquid absorber 22 in FIG. 1 is the "absorber configured to absorb the liquid discharged from the liquid discharge head" of the present teaching. However, the absorber of the present teaching is not limited to this embodiment. For example, a flushing absorber may be provided on the platen 2. By providing the flushing absorber on the platen 2, it is possible to shorten the moving distance and moving time of the ink-jet head 4 between the flushing period during which the flushing operation is performed and the recording period during which the recording operation is performed. Further, a platen absorber may be arrange on the platen 2 at a portion in which an end or edge portion of the recording medium (recording paper) P passes. In case of performing a borderless recording with respect to the recording paper P, it is possible to absorb, with the platen absorber, an ink (liquid) discharged onto the platen beyond the end portion of the recording paper P. By allowing the platen absorber to contain the glycol ether (second glycol ether) of which vapor pressure is lower than that of the glycol ether (first glycol ether) contained in the liquid, it is possible to reduce the volatilization of the glycol ether contained in the liquid.

As explained about, according to the present teaching, it is possible to reduce the volatilization of the glycol ether contained in the liquid, by causing the absorber, containing another glycol ether of which vapor pressure is lower than that of the glycol ether contained in the liquid, to absorb the liquid discharged from the liquid discharge head.

EXAMPLES

Next, examples of the present teaching will be explained together with a comparative example. Note that the present teaching is not limited and is not restricted to the examples and the comparative example which will be described below.

Examples 1-8 and Comparative Example 1

A melamine foam (surface area: 1 $cm^2$, thickness: 5 mm) was placed in a vial bottle for HS-GC/MS (Head Space-Gas Chromatography/Mass Spectrometry) measurement. Next, 100 μL of an ink was permeated into the melamine foam and was kept at a temperature of 60 degrees Celsius for 30 minutes. As the ink, each of four kinds of inks having compositions shown in TABLE 3 as follows was used. After the temperature keeping, gas was poured or supplied from the vial bottle to the GS/MS for 0.05 minutes and the measurement was performed. Thus, the total of the peak areas of the glycol ethers contained in the inks were calculated. Further, the melamine foam was placed in a vial bottle for the HS-GC/MS measurement. Next, 100 μL of each of glycol ethers as measurement objectives was permeated into the melamine foam, and then the total of the peak areas of the glycol ethers contained in the inks were calculated, in a similar manner as described above. Further, the reduction rate of the volatilization of the glycol ether contained in the ink was calculated for each of the examples and the comparative example by the following formula. With such a model experiment, the degree of suppressing the volatilization by the combination of the glycol ether contained in the ink and the glycol ether permeated in the melamine foam was confirmed.

$$\text{Reduction Rate (\%)}=\{(X-Y)/X\}\times 100$$

wherein in the formula,

X: Total of the peak areas in the ink itself

Y: Total of the peak areas in a case that the glycol ether as the measurement objective was permeated in the melamine foam.

TABLE 3

| | | INK | | | |
|---|---|---|---|---|---|
| | | Ink 1 | Ink 2 | Ink 3 | Ink 4 |
| Ink Composition (% by weight) | Pigment dispersant (10% aqueous solution) | 60.0 | 60.0 | 60.0 | 60.0 |
| | Glycerol | 3.5 | 3.5 | 3.5 | 3.5 |
| | Triethylene glycol | 4.0 | 4.0 | 4.0 | 4.0 |
| | Diethylene glycol | 8.0 | 8.0 | 8.0 | 8.0 |
| | PM | 1.0 | — | — | — |
| | PE | — | 1.0 | — | — |
| | PB | — | — | 1.0 | — |
| | DPP | — | — | — | 1.0 |
| | Surfactant | 0.5 | 0.5 | 0.5 | 0.5 |
| | Water | balance | balance | balance | balance |

The results of measurement of Examples 1-8 and Comparative Example 1 are shown in TABLE 4 as follows.

TABLE 4

| | EXAMPLES | | | | | | | | COM. EX. COM. |
|---|---|---|---|---|---|---|---|---|---|
| | EX. 1 | EX. 2 | EX. 3 | EX. 4 | EX. 5 | EX. 6 | EX. 7 | EX. 8 | EX. 1 |
| Ink | Ink 1 | Ink 1 | Ink 1 | Ink 2 | Ink 3 | Ink 4 | Ink 4 | Ink 4 | Ink 4 |
| Glycol ether contained in the ink | PM | PM | PM | PE | PB | DPP | DPP | DPP | DPP |
| Vapor pressure (hPa-20 C. °) | 8.9 | 8.9 | 8.9 | 10 | 0.8 | 0.1 | 0.1 | 0.1 | 0.1 |
| Glycol ether permeated in the melamine foam | TEB | TeEB | TPB | TeEB | TeEB | TEB | TeEB | TPB | PE |
| Vapor pressure (hPa-20 C. °) | <0.01 | <0.01 | <0.01 | <0.01 | <0.01 | <0.01 | <0.01 | <0.01 | 10 |
| Reduction rate (%) | 44 | 47 | 48 | 52 | 62 | 92 | 98 | 99 | 0 |

As shown in TABLE 4, in Comparative Example 1 wherein glycol ether of which vapor pressure was higher than that of glycol ether contained in the ink was permeated in the melamine foam, the reduction rate was 0% and the glycol ether contained in the ink was completely volatilized. On the other hand, in each of Examples 1-8 wherein glycol ether of which vapor pressure was lower than that of glycol ether contained in the ink was permeated in the melamine foam, the reduction rate was not less than 40% and the volatilization of the glycol ether contained in the ink was reduced. In each of Examples 6, 7 and 8 wherein the glycol ether contained in the ink was dipropylene glycol propyl ether and the non-volatile glycol ether permeated in the melamine foam was triethylene glycol butyl ether, tetraethylene glycol butyl ether or tripropylene glycol butyl ether, the volatilization was particularly suppressed.

As described above, the liquid discharge recording apparatus of the present teaching is capable of reducing the generation of VOC. The usage of the liquid discharge recording apparatus of the present teaching is not particularly limited, and is widely applicable to a variety of kinds of ink-jet recording.

What is claimed is:

1. A liquid discharge recording apparatus comprising:

a liquid containing first glycol ether;

a liquid discharge head configured to discharge the liquid;

an absorber configured to absorb the liquid discharged from the liquid discharge head; and second glycol ether which is contained in the absorber and of which vapor pressure is lower than that of the first glycol ether, wherein the first glycol ether is selected from the group consisting of propylene glycol ethyl ether, dipropylene glycol propyl ether, propylene glycol butyl ether, and a combination thereof; and the second glycol ether is selected from the group consisting of tetraethylene glycol butyl ether, tripropylene glycol butyl ether, and a combination thereof.

2. The liquid discharge recording apparatus according to claim 1, wherein the first glycol ether is dipropylene glycol propyl ether; and the second glycol ether is selected from the group consisting of tetraethylene glycol butyl ether, tripropylene glycol butyl ether, and a combination thereof.

3. The liquid discharge recording apparatus according to claim 1, wherein the first glycol ether is dipropylene glycol propyl ether; and the second glycol ether is tetraethylene glycol butyl ether.

4. The liquid discharge recording apparatus according to claim 1, wherein the first glycol ether is dipropylene glycol propyl ether; and the second glycol ether is tripropylene glycol butyl ether.

5. The liquid discharge recording apparatus according to claim 1, wherein the liquid is a water-based ink.

6. The liquid discharge recording apparatus according to claim 1, wherein the liquid is a preservative liquid.

7. The liquid discharge recording apparatus according to claim 1, wherein the absorber is a flushing absorber configured to face the liquid discharge head and receive the liquid discharged from the liquid discharge head.

8. The liquid discharge recording apparatus according to claim 1, wherein the absorber is a melamine foam.

9. A liquid discharge recording apparatus comprising:

a liquid containing first glycol ether;

a liquid discharge head configured to discharge the liquid;

an absorber configured to absorb the liquid discharged from the liquid discharge head; and second glycol ether which is contained in the absorber and of which vapor pressure is lower than that of the first glycol ether, wherein an amount of the second glycol ether contained per 1 $mm^3$ of the absorber is not less than 0.1 $\mu g/mm^3$, and is not more than 0.91 $\mu g/mm^3$.

10. A liquid discharge recording apparatus comprising:

a liquid containing first glycol ether;

a liquid discharge head configured to discharge the liquid;

an absorber configured to absorb the liquid discharged from the liquid discharge head; and second glycol ether which is contained in the absorber and of which vapor pressure is lower than that of the first glycol ether, wherein an amount of the second glycol ether contained in the flushing absorber is not less than 0.10 g, and is not more than 0.81 g.

* * * * *